US005909970A

United States Patent [19]

Velazquez

[11] Patent Number: 5,909,970

[45] Date of Patent: Jun. 8, 1999

[54] PORTABLE BATHING APPARATUS

[76] Inventor: Cristobal F. Velazquez, 6915 W. 15 Ave., Hialeah, Fla. 33014

[21] Appl. No.: 09/157,126

[22] Filed: Sep. 18, 1998

[51] Int. Cl.[6] ..... A47K 3/06

[52] U.S. Cl. ..... 4/585; 5/606; 5/928

[58] Field of Search ..... 4/580, 584–588; 5/606, 928

[56] References Cited

U.S. PATENT DOCUMENTS

| | | | |
|---|---|---|---|
| 962,954 | 6/1910 | Green | 4/585 |
| 2,878,488 | 3/1959 | Doskocil | 4/580 |
| 3,246,346 | 4/1966 | Schmidt | 4/585 |
| 3,800,336 | 4/1974 | Hoxeng | 4/177 |
| 4,312,084 | 1/1982 | Browning | 4/585 |
| 4,485,502 | 12/1984 | Marcanio | 4/585 |
| 5,522,099 | 6/1996 | Heier | 5/606 |
| 5,678,257 | 10/1997 | Morcate et al. | 4/585 |

FOREIGN PATENT DOCUMENTS

| | | | |
|---|---|---|---|
| 65878 | 10/1926 | Sweden | 4/585 |

*Primary Examiner*—Charles R. Eloshway
*Attorney, Agent, or Firm*—J. Sanchelima

[57] ABSTRACT

A bathing apparatus to be used on a mattress and being collapsible for volumetric efficient storage and transportation. An impermeable, pliable and semi-flexible sheet has a peripheral edge portion which includes a fold as a peripheral end or rim. The edge portion is kept at a position above the mattress so that the sheet may contain liquids. To keep the peripheral edge portion at this position several arm support assemblies are mounted perpendicular to the mattress around its perimeter. The distal ends of the arm members in the arm support assemblies coact with cooperatively exposed areas of the peripheral fold. A flexible cord is passed through the fold and kept sufficiently tensed to keep the peripheral edge portion at a substantially perpendicular relationship with respect to the plane of the mattress.

5 Claims, 1 Drawing Sheet

PORTABLE BATHING APPARATUS

BACKGROUND OF THE INVENTION

1. Field of the Invention

The present invention relates to a foldable and portable bathing assembly to be used in bed, such as for handicapped, aged people, and for ill patients in hospitals.

2. Description of the Related Art

Applicant believes that the closest reference corresponds to U.S. Pat. No. 3,800,336 issued on Apr. 2, 1974 to Hoxeng for a portable bed bath. It includes a waterproof sheet that forms the bath tub. However, it differs from the present invention because it needs a frame for the sheet to be installed around the bed. This patented invention's frame can not be used with any bed since it needs frames of different dimensions for each kind of bed.

Another design for a portable, self-contained bathing apparatus for incapacitated bedridden individuals is disclosed in U.S. Pat. No. 5,678,257 issued on Oct. 21, 1997 to Morcate et al. This patented invention, however, requires the use of telescopic members 32 with the need to provide for these design features.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a bathing apparatus that can be readily mounted to rectangular mattresses.

It is another object of this invention to provide an adequate, safe, efficient, hygienic and easy-to-use apparatus for bathing patients.

It is still another object of the present invention to provide an apparatus that permits a user to be bathed with minimum effort and help from others.

It is yet another object of this invention to provide such a device that is inexpensive to manufacture and use while retaining its effectiveness. The device is relatively easy to make, and does fold and unfold quickly without complete disassembly. It can be employed in a large number of different bed sizes and can be used with a minimum of labor.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
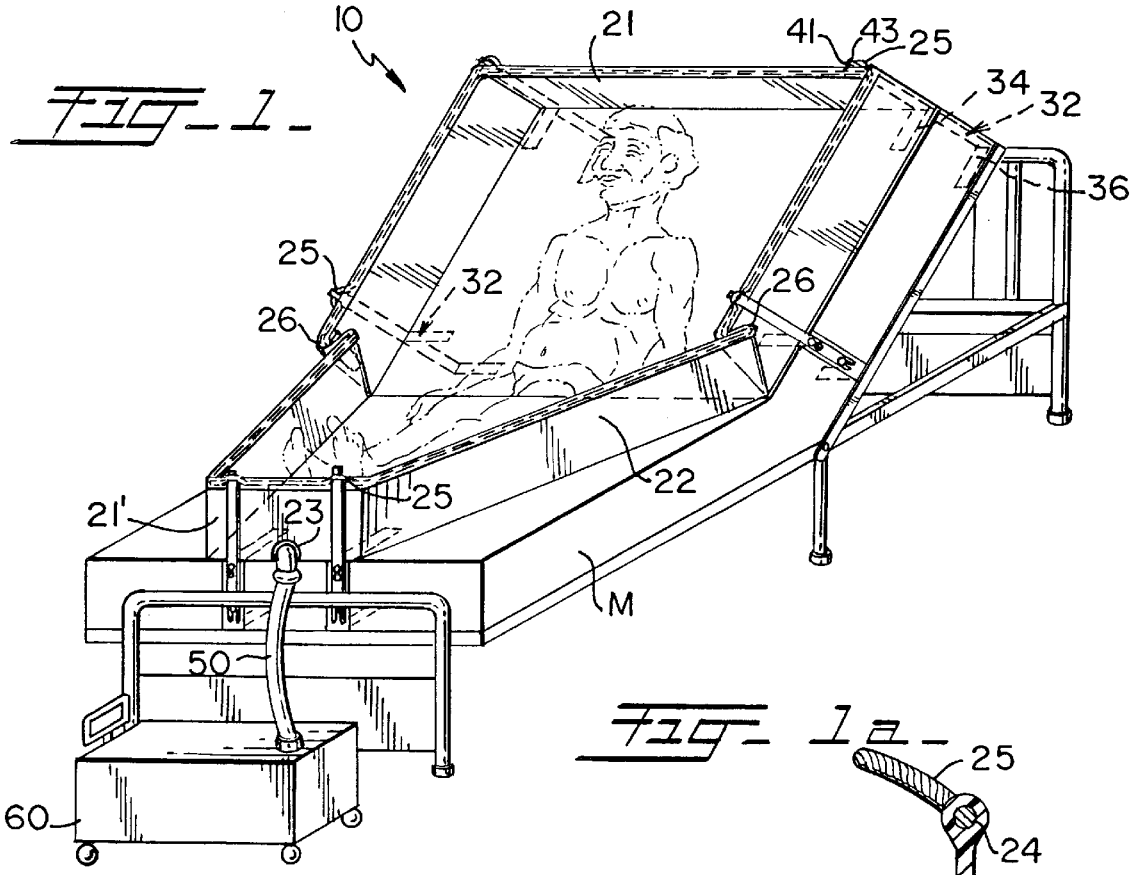
FIG. 1 represents an isometric view of one of the preferred embodiments of the present invention mounted on a mattress.
Figure 1A:
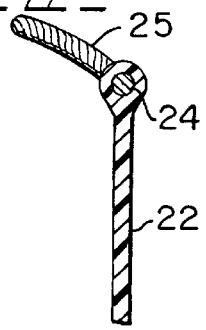
FIG. 1*a* is an enlarged detail cross-sectional view of the loop.
Figure 2:
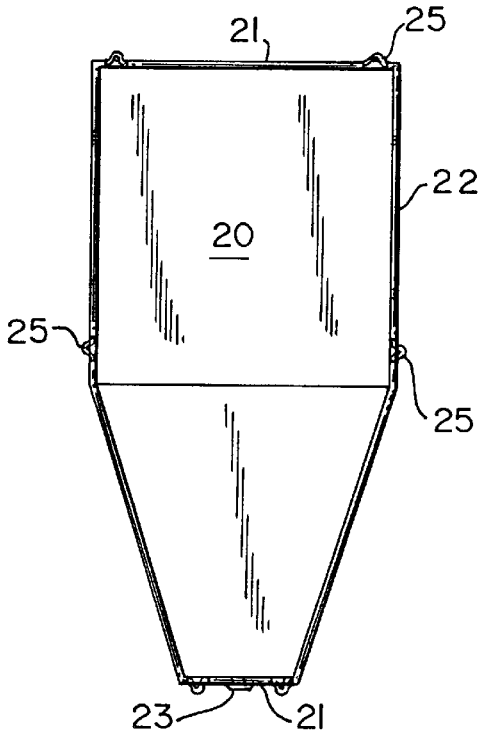
FIG. 2 shows a top view of the bathing apparatus represented in the previous figures.
Figure 3:
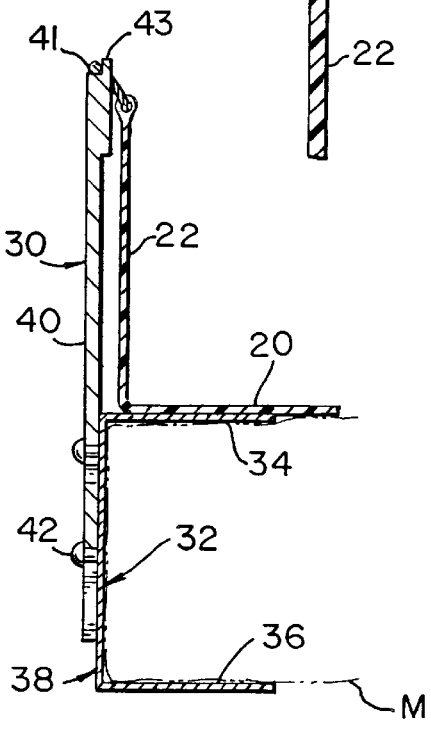
FIG. 3 illustrates a detailed partial cross-section of one of the supporting arms.

Referring now to the drawings, where the present invention is generally referred to with numeral 10, it can be observed that it basically includes a pliable and impermeable sheet 20 with peripheral edge portion 22 and cord member 24 passing through fold 26 mounted to edge 22. Support arm assembly 30 includes removable resilient clip member 32 that has two spaced apart holding plates 34 and 36 separated by spacer plate 38. Plates 34 and 36 sandwich mattress M, spacer plate 38 has substantially the depth of mattress M, arm member 40 is mounted to spacer plate 38 by fastener member 42. Arm member 40 has two pairs of holes therein as shown in FIG. 1 (unnumbered). Fastener members 42, which are attached to spacer plate 38, fit into a respective hole in each pair of holes for permitting telescopic adjustment of the arm member 40 relative to spacer plate 38. Pin 43 extends longitudinally providing end 41 a suitable protrusion for engaging loop 25. Loop 25 is formed by cord member 24 in the preferred embodiment. Cord member 24 can be pulled to adjust its tension in order to keep edge portion 22 substantially perpendicular with respect to bottom of the sheet 20. Fold 26 exposes cord member 24 in certain places to permit its removable attachment to pin 43. Since arm member 40 is positioned perpendicularly with respect to the plane of mattress M, pin 43 keeps edge 22 raised with the help of cord 24 that runs through fold 26.

Sheet 20 is a semi-flexible material and it has one end 21 narrower than the other one 21. One longitudinal half of sheet 20 has a substantially rectangular shape. The other adjoining half has smaller width away from the center portion, ending in a substantially smaller end 21. Drain part 23 is located on end 21 and is connected to one end of hose 50. The other end of hose 50 is connected to water storage tank 60.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A bathing apparatus adapted to be removably mounted over a mattress having a peripheral lateral wall, comprising:

A) a semi-flexible and impermeable sheet having two ends, and said sheet having a peripheral edge portion with a fold;

B) a plurality of elongated supporting means adapted to be removably mounted to said mattress and extend substantially perpendicularly with respect to the plane of said mattress, and each of said elongated supporting means including a distal end extending upwardly above said mattress, and each of said elongated supporting means further including a clip that includes two spaced apart plates that cooperatively sandwich said peripheral lateral wall;

C) a cord that is passed through said fold, and said fold having exposed areas so that said cord can be removably attached to said distal ends at said exposed areas; and D) draining means mounted to one of said ends and below said peripheral edge.

2. The bathing apparatus set forth in claim 1 wherein one of said ends is wider than the other one.

3. The bathing apparatus set forth in claim 2 further including:

E) water storage means for collecting the liquids drained through said draining means.

4. The bathing apparatus set forth in claim 3 wherein each of said distal ends includes a pin for cooperative engagement with said cord.

5. The bathing apparatus set forth in claim 4 wherein each of said elongated supporting means includes a telescopically mounted arm member for selectively adjusting the height of said distal end.

* * * * *